US007942098B2

(12) United States Patent
Han et al.

(10) Patent No.: US 7,942,098 B2
(45) Date of Patent: May 17, 2011

(54) LOADING TUBE FOR SHAPED CHARGES

(75) Inventors: Chenghua Han, Sugar Land, TX (US); Bennie Gill, Fulshire, TX (US); Mark C. Duhon, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/561,619

(22) Filed: Nov. 20, 2006

(65) Prior Publication Data

US 2008/0121095 A1 May 29, 2008

Related U.S. Application Data

(60) Provisional application No. 60/823,810, filed on Aug. 29, 2006.

(51) Int. Cl.
*F41F 5/00* (2006.01)

(52) U.S. Cl. ..... 102/320; 102/313; 89/1.15

(58) Field of Classification Search ..... 102/313, 102/310, 320; 89/1.15; 175/4.6; 166/55.1, 166/297

See application file for complete search history.

(56) References Cited

U.S. PATENT DOCUMENTS

| | | | | |
|---|---|---|---|---|
| 2,742,857 | A * | 4/1956 | Turechek | 102/310 |
| 2,764,938 | A * | 10/1956 | Harcus | 175/4.6 |
| 2,849,953 | A | 9/1958 | Delacour | |
| 2,953,971 | A | 9/1960 | Porter | |
| 4,326,462 | A * | 4/1982 | Garcia et al. | 102/310 |
| 4,428,440 | A * | 1/1984 | McPhee | 175/4.6 |
| 4,598,775 | A * | 7/1986 | Vann et al. | 175/4.6 |
| 4,658,900 | A * | 4/1987 | Stout | 166/297 |
| 4,694,754 | A | 9/1987 | Dines | |
| 4,716,833 | A * | 1/1988 | Regalbuto | 102/320 |
| 4,753,301 | A * | 6/1988 | Berry | 175/4.6 |
| 4,800,815 | A * | 1/1989 | Appledorn et al. | 102/321 |
| 4,889,183 | A * | 12/1989 | Sommers et al. | 166/55 |
| 5,148,868 | A * | 9/1992 | Christian | 166/297 |
| 5,648,635 | A * | 7/1997 | Lussier et al. | 102/307 |
| 5,816,343 | A * | 10/1998 | Markel et al. | 175/4.51 |
| 5,837,925 | A * | 11/1998 | Nice | 102/310 |
| 6,014,933 | A * | 1/2000 | Umphries et al. | 102/312 |
| 6,158,511 | A * | 12/2000 | Wesson | 166/308.1 |
| 6,289,991 | B1 * | 9/2001 | French | 166/382 |
| 6,439,121 | B1 * | 8/2002 | Gillingham | 102/312 |
| 6,487,973 | B1 * | 12/2002 | Gilbert et al. | 102/312 |
| 6,497,285 | B2 | 12/2002 | Walker | |
| 6,591,911 | B1 * | 7/2003 | Markel et al. | 166/297 |

(Continued)

FOREIGN PATENT DOCUMENTS

| | | | |
|---|---|---|---|
| EP | 0874130 | B1 | 1/2006 |
| GB | 2308177 | A | 6/1997 |
| GB | 2380536 | A | 4/2003 |
| GB | 2394762 | A | 5/2004 |
| GB | 2394763 | A | 5/2004 |
| GB | 2410785 | A | 8/2005 |
| WO | 0107860 | A2 | 2/2001 |
| WO | 2005066455 | A1 | 7/2005 |

*Primary Examiner* — Michael Carone
*Assistant Examiner* — Daniel J Troy
(74) *Attorney, Agent, or Firm* — Kevin B. McGoff; Rodney V. Warfford; Tim Curington

(57) ABSTRACT

A loading tube for use in a perforating gun is disclosed which eliminates the necessity for utilization of plastic jackets to restrain shaped charges. The loading tube comprises a first tubular member and an engagement structure in the first tubular member in which the primer ends of the shaped charges may be installed. These engagement structures may be a center plate or inner tubular members. In each of the disclosed embodiments, a detonating cord connects the primer ends of the shaped charges which are installed in the loading tube.

6 Claims, 4 Drawing Sheets

U.S. PATENT DOCUMENTS

| | | | | |
|---|---|---|---|---|
| 6,865,978 | B2 | 3/2005 | Kash | |
| 6,896,059 | B2 | 5/2005 | Brooks | |
| 6,991,044 | B2 * | 1/2006 | Zhang et al. | 175/4.6 |
| 7,159,657 | B2 * | 1/2007 | Ratanasirigulchia et al. | 166/299 |
| 2002/0096040 | A1 * | 7/2002 | Barker et al. | 89/1.15 |
| 2002/0189482 | A1 | 12/2002 | Kneisl | |
| 2004/0107825 | A1 * | 6/2004 | Kash | 89/1.15 |
| 2005/0173118 | A1 * | 8/2005 | Ll et al. | 166/297 |
| 2005/0211467 | A1 | 9/2005 | Ratanasirigulchia | |
| 2006/0075889 | A1 * | 4/2006 | Walker | 89/1.15 |
| 2006/0201371 | A1 * | 9/2006 | Li et al. | 102/307 |
| 2007/0107589 | A1 * | 5/2007 | Rospek et al. | 89/1.15 |

* cited by examiner

LOADING TUBE FOR SHAPED CHARGES

CROSS-REFERENCE TO RELATED APPLICATION

The present application claims the benefit of the filing date of Provisional Application No. 60/823,810, filed Aug. 29, 2006.

BACKGROUND OF THE INVENTION

1. Field of the Invention

The present invention relates to perforating gun apparatus, and more particularly, to a loading tube for shaped charges that eliminates the utilization of plastic jacket assemblies around the charges.

2. Description of the Prior Art

For purposes of enhancing production from a subterranean formation, a perforating gun typically is lowered down into a wellbore that extends through the formation. A perforating gun may, for example, comprise a plurality of radially-oriented shaped charges which are detonated to form perforations in the formation proximate the wellbore. The shaped charges may, for example, be placed at points along a helical spiral that extends around a longitudinal axis of the perforating gun.

A perforating gun usually comprises a tubular-shaped loading tube. After the shaped charges are installed in the loading tube, it is then inserted into a carrier tube. A detonating cord connects the shaped charges in the loading tube into the ballistic train of the perforating gun string. Plastic jackets have routinely been used to restrain the shaped charges in place in the loading tube.

Shaped charges are usually designed for specific sizes of gun systems due to geometric constraints and in-gun clearance requirements. Loading tubes and plastic jackets are engineered to fit in a specific shaped charge. Occasionally, smaller size charges need to be used in larger guns. In such a situation, the existing jacket and loading tube originally designed for the charge are usually no longer useful, and modifications and re-engineering are required.

Plastic jackets are usually made by use of injection molding equipment, and it is difficult to accommodate changes or modifications in such equipment in terms of time and cost. Any changes to the existing jacket design require re-tooling, which usually requires a heavy initial investment and takes a long period of time to implement. Another drawback that plastic jackets have is that their use may reduce the maximum shot density. Yet another drawback to the utilization of plastic jackets is that, once the shaped charges are detonated downhole, the plastic material may create a huge amount of debris in the well which could not only hinder production from the well, but also cause the well to stop producing.

SUMMARY OF THE INVENTION

In accordance with the present invention, a loading tube is provided for use in a perforating gun. The loading tube comprises a first tubular member and engagement apparatus disposed in the first tubular member for engaging the primer ends of shaped charges.

In one embodiment, the engagement structure comprises a center plate disposed in the first tubular member for engagement of the primer ends of a plurality of shaped charges. The center plate has a length which is substantially equal to the length of the first tubular member and has a width which is substantially equal to the inner diameter of the first tubular member.

In this embodiment, the loading tube has openings formed in the first tubular member above and below the center plate for insertion of the shaped charges. The center plate has corresponding openings formed in it for receiving and engaging the primer ends of the shaped charges. The loading tube further comprises a detonating cord which is connected to the primer ends of the shaped charges installed in the loading tube.

In another embodiment of the present invention, the engagement structure comprises an inner tubular member which is disposed in the first tubular member. The primer ends of a plurality of shaped charges may be engaged in openings formed in the inner tubular member. The inner tubular member has a length which is substantially equal to the length of the first tubular member.

In this embodiment, the loading tube according to the present invention has openings formed in the first tubular member where shaped charges are to be installed and the inner tubular member has corresponding openings formed in it for receiving and engaging the primer ends of the shaped charges.

In one embodiment of the present invention, the inner tubular member is concentric with the first tubular member. In another embodiment of the present invention, the inner tubular member is positioned in the first tubular member in contact with the inner surface of the first tubular member. In each of these embodiments, a loading tube in accordance with the present invention comprises a detonating cord which connects the primer ends of the shaped charges together.

In accordance with the present invention, a perforating string is provided comprising a plurality of perforating gun sections where each perforating gun section comprises a carrier, and a loading tube installed in the carrier. Each said loading tube comprises a first tubular member and an engagement structure disposed in the first tubular member for engagement of the primer ends of a plurality of shaped charges. A detonating cord is provided which is connected to all of the primer ends of the shaped charges in the loading tube.

In one embodiment, a perforating string according to the present invention includes an engagement structure comprising a center plate having a length substantially equal to the length of the first tubular member and width substantially equal to the diameter of the first tubular member. In yet another embodiment of the present invention, the engagement structure is an inner tubular member having a length which is substantially the same as the length of the first tubular member. The inner tubular member may be concentric with the first tubular member or may be positioned in contact with the inner diameter of the first tubular member.

DESCRIPTION OF THE SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations and modifications from the described embodiments may be possible. The following description is thus intended to illustrate and not to limit the present invention.

Figure 1:
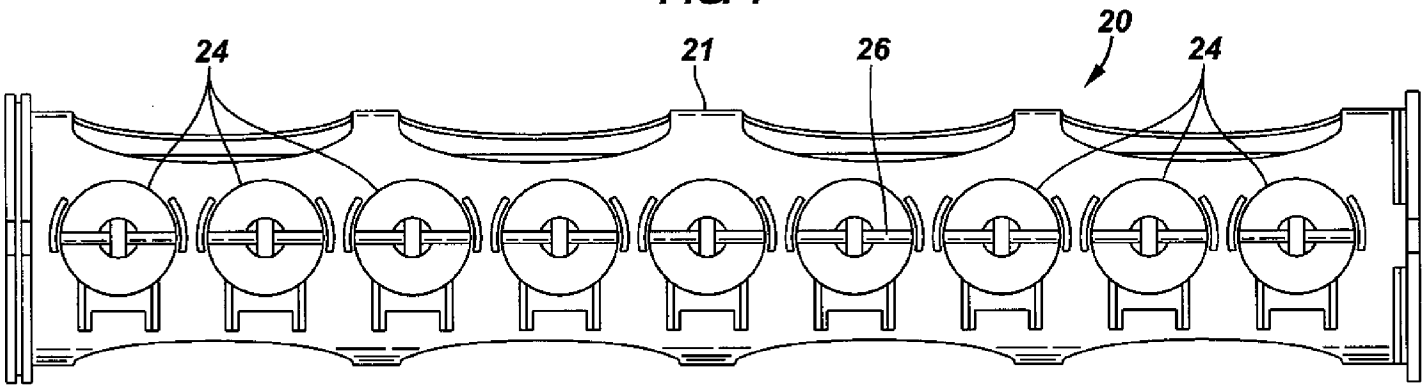
FIG. 1 is a top view of one embodiment of loading tube apparatus in accordance with the present invention.
Figure 2:
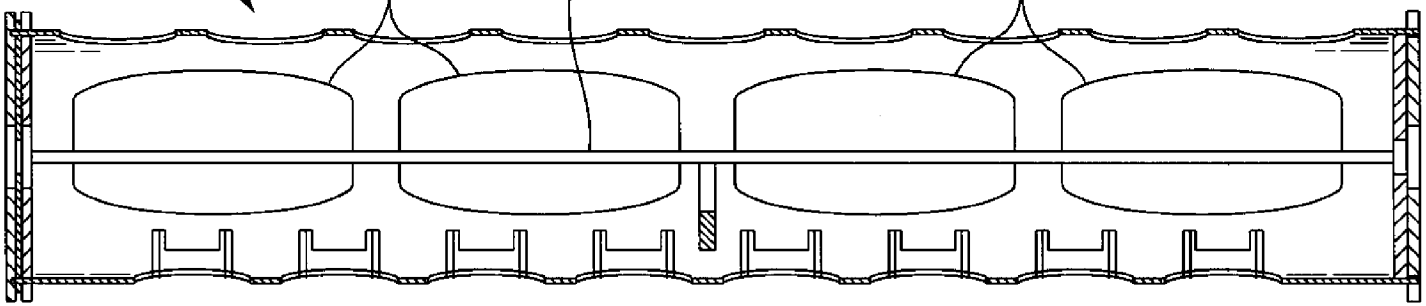
FIG. 2 is a side view in partial cross-section taken along the longitudinal axis of the loading tube apparatus of FIG. 1.
Figure 3:
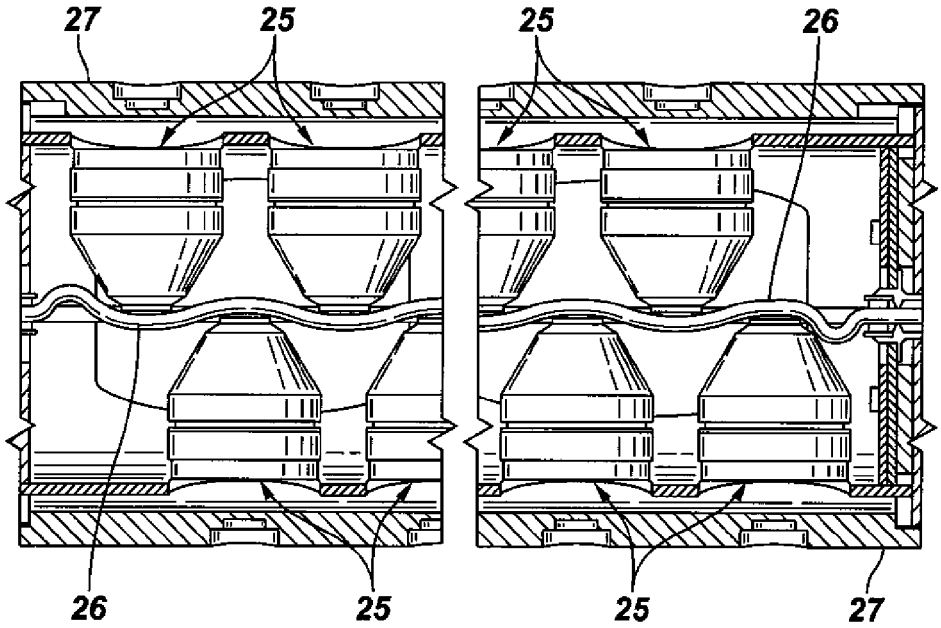
FIG. 3 is a cross-sectional view taken along the longitudinal axis of a perforating gun section containing the loading tube apparatus of FIG. 1 in which shaped charges are installed.
Figure 3A:
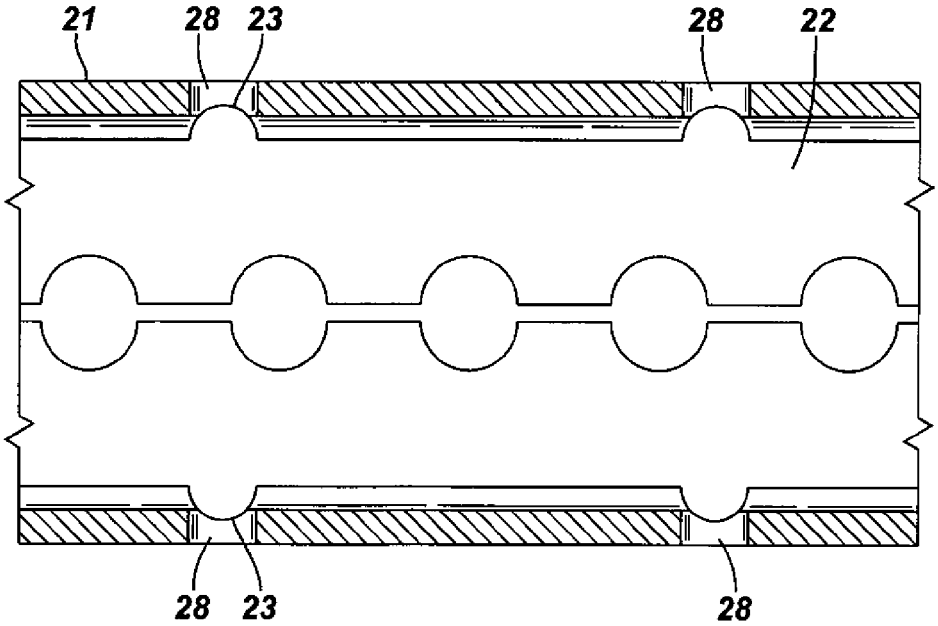
FIG. 3A is a top view in partial cross-section of the loading tube with center plate 22 of FIGS. 1-3.

With reference first to FIGS. 1-3 and 3A, there is illustrated one embodiment of a loading tube 20 which is particularly suitable for planar phasing such as 0/180 or 90/270 degree perforating. Loading tube 20 comprises a tubular member 21. In this embodiment, the engagement apparatus of loading tube 20 comprises a center plate 22 which is installed in tubular member 21. The length of center plate 22 is substantially the same as the length of tubular member 21 and the width of center plate 22 is substantially the same as the inner diameter of tubular member 21. The installation of center plate 22 into tubular member 21 may, for example, be effected by spot-welding a plurality of tabs 23 along each side of the length of the center plate 22 to tubular member 21 at the openings 28 formed in the walls of tubular member 21, as illustrated in FIG. 3A.

A plurality of openings 24 may be formed in tubular member 21 to receive a plurality of shaped charges 25. Openings are also formed in the center plate 22 to receive the primer ends of the shaped charges. Shaped charges 25 may be engaged in center plate 22 by a variety of mechanisms, e.g., by forming the primer end of the shaped charge in a manner such that it will matingly engage the opening formed in the center plate 22. A detonating cord 26 is connected to the primer ends of shaped charges 25. The detonating cord 26 runs the length of the loading tube 20 and is disposed in a slot in the center plate.

The installation of shaped charges 25 into the tubular member 21 may be enhanced by forming openings 29 in tubular member 21. After installation of the shaped charges 25 into the tubular member 21, tubular member 21 is installed into carrier 27.

Figure 4:
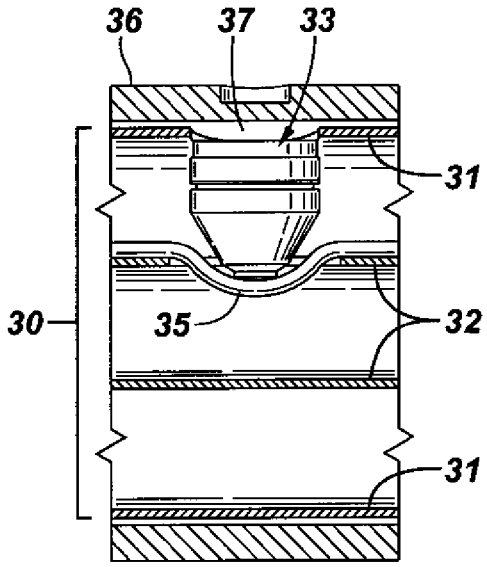
FIG. 4 is a cross-sectional view along a portion of the longitudinal axis of a second embodiment of loading tube apparatus in accordance with the present invention.
Figure 5:
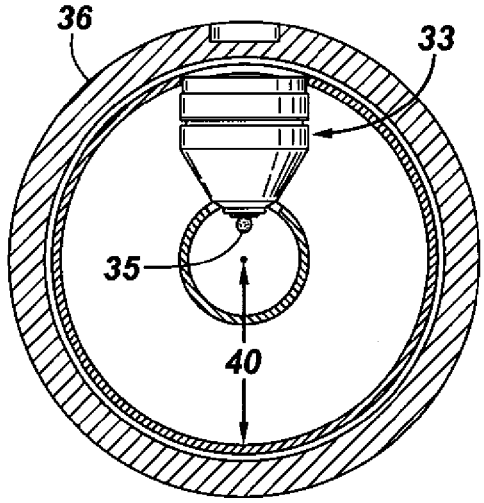
FIG. 5 is a cross-sectional view of the loading tube apparatus of FIG. 4 taken perpendicular to the longitudinal axis of the loading tube.
Figure 5A:
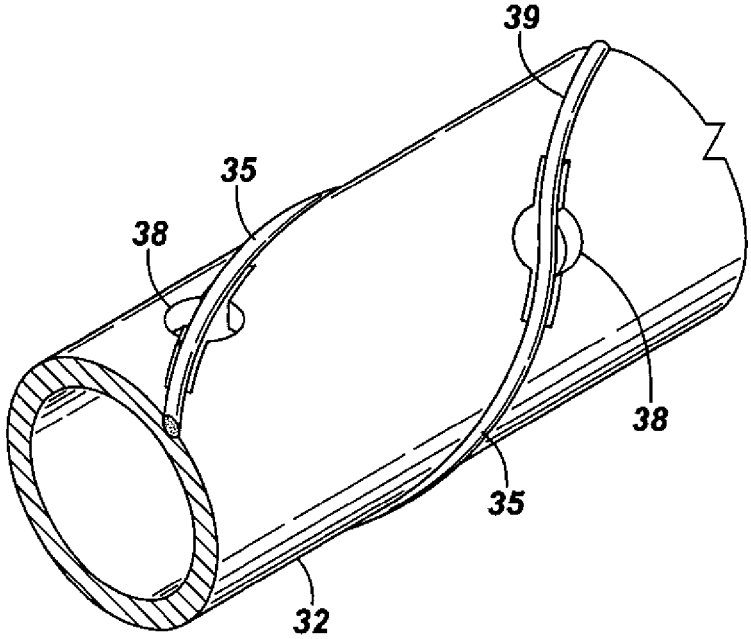
FIG. 5A is a perspective view of a portion of the inner tube illustrated in FIGS. 4 and 5.

With reference now to FIGS. 4, 5 and 5A, there is illustrated a second embodiment of a loading tube 30 in accordance with the present invention. Loading tube 30 comprises two concentric tubes 31 and 32 which may be cut at any given phase pattern and geometries that fit a charge. Openings 37 and 38 are formed in outer tube 31 and the inner tube 32 respectively for the insertion of shaped charges 33. A detonating cord 35 is wound around the outer surface of the inner tube 32 along generally helically-shaped detonation cord guide cut 39 in the inner tube 32. The detonating cord guide cut may also be formed as a straight cut from one end of inner tube 32 to the other. In one embodiment, the guide cut may be a slot, while in another embodiment the guide cut may be a grove. The shaped charges 33 firmly engage in the inner tube 32 and are suppressed in their longitudinal direction by tabs (not shown) which are bent at the top. Since the detonating cord 35 is on the outer surface of inner tube, the primer ends shaped charges 33 firmly engage the detonating cord 35. Once the spaced charges have been installed in the loading tube, the loading tube may be installed in the carrier 36.

Loading tube 30 illustrated in FIGS. 4 and 5 may be especially useful to provide a multiple phase perforating gun containing small charges, where a small charge may, for example, be defined as one whose longitudinal length is smaller than the inner radius 40 of the gun carrier.

Figure 6:
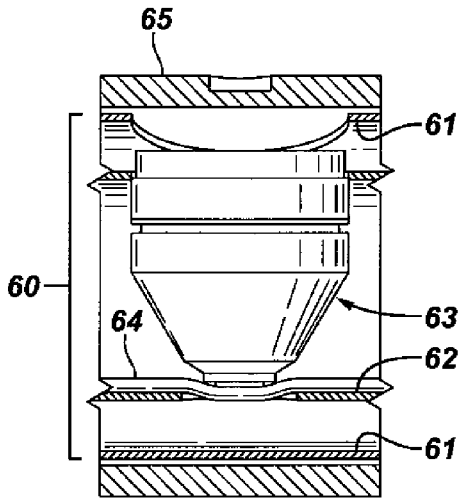
FIG. 6 is a cross-sectional view along a portion of the longitudinal axis of a third embodiment of loading tube apparatus in accordance with the present invention.
Figure 7:
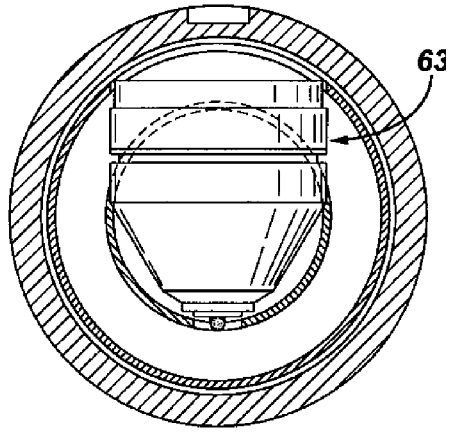
FIG. 7 is a cross-sectional view of the loading tube apparatus of FIG. 6 taken perpendicular to the longitudinal axis of the loading tube.

With reference now to FIGS. 6 and 7, another embodiment of a loading tube in accordance with the present invention is illustrated. Loading tube 60 is primarily designed for use with medium-sized charges which have a longitudinal length that is greater than the inner radius of the carrier. Loading tube 60 comprises a tubular member 61 and an inner tubular member 62. In this embodiment the inner tube 62 is larger in diameter than the diameter of inner tube 32 in FIGS. 4 and 5. Openings are formed in tubular member 61 and inner tubular member 62 to receive shaped charge 63. A detonation cord 64 runs inside the inner tube along its inner surface instead of on the outer surface of the inner tube as in FIGS. 4 and 5. Detonation card 64 is connected to the primer ends of shaped charges 63. After assembly, the loading tube 60 is installed in carrier 65.

Figure 8:
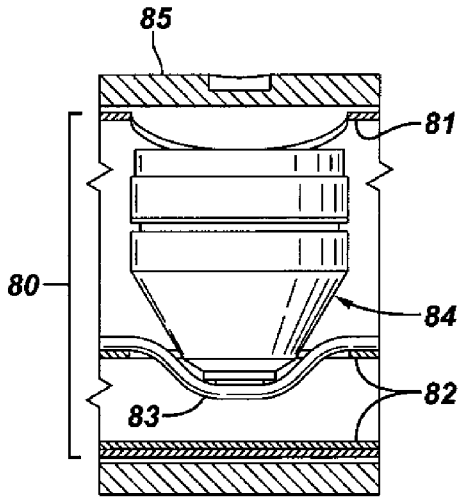
FIG. 8 is a cross-sectional view along a portion of the longitudinal axis of a fourth embodiment of loading tube apparatus in accordance with the present invention.
Figure 9:
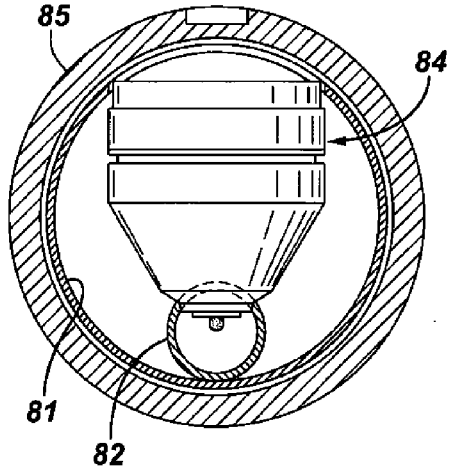
FIG. 9 is a cross-sectional view of the loading tube apparatus of FIG. 8 taken perpendicular to the longitudinal axis of the loading tube.

With reference now to FIGS. 8 and 9, there is illustrated yet another embodiment of a loading tube in accordance with the present invention. Loading tube 80 comprises an outer tubular member 81 and an inner tubular member 82. The inner tubular member 82 is positioned the inner surface of the outer tubular member 81. A detonation cord 83 runs up and down following with the detonation cord guides cut in inner tubular member 82 in its longitudinal direction. Tabs (not shown) are provided in outer tubular member 81 to restrict charge move in its longitudinal direction and lateral direction. The inner tubular member 82 provides support to the charge 84 as well as restraining its lateral movements. The embodiment shown in FIGS. 8 and 9 is especially adaptable for use in a single or non-continuous phase perforating gun.

What is claimed is:

1. A perforating gun, comprising:

a carrier;

a loading tube installed inside of the carrier, comprising:

a tubular member having a first end, a second end and an inner diameter;

a plurality of shaped charges received in openings formed in the tubular member; and an engagement structure disposed in the tubular member into which primer ends of the plurality of shaped charges are installed, wherein the engagement structure has a length that is substantially equal to the length of the tubular member, a width that is equal to the inner diameter of the tubular member and the entire engagement structure is disposed between the first end and the second end of the tubular member; and a detonator cord which is connected to the primer ends of the plurality of shaped charges in the loading tube.

2. The perforating gun of claim 1, wherein the engagement structure comprises a center plate.

3. A perforating gun, comprising:

a tubular carrier;

a loading tube disposed in the tubular carrier;

a center plate disposed in the loading tube, the center plate having a width equal to an inner diameter of the loading tube and a length substantially equal to the lenght of the loading tube;

openings formed in the loading tube on opposite sides of the center plate; and a shaped charge received in each of the openings, each of the shaped charges having a primer end received by the center plate.

4. The perforating gun of claim 3, further comprising a detonating cord connected to each of the primer ends of the plurality of shaped charges.

5. The perforating gun of claim 3, wherein the center plate is welded inside of the loading tube.

6. The perforating gun of claim 3, further comprising at least one second opening formed through the loading tube, the at least one second opening oriented transverse to the openings receiving the shaped charges.

* * * * *